United States Patent [19]

Jones

[11] 4,006,495

[45] Feb. 8, 1977

[54] COAT CONSTRUCTION

[76] Inventor: John Roger Jones, 206 8th Ave., Salt Lake City, Utah 84102

[22] Filed: Sept. 15, 1975

[21] Appl. No.: 613,456

[52] U.S. Cl. ..... 2/93; 2/126; 2/250; 2/DIG. 6

[51] Int. Cl.[2] ..... A41D 1/02

[58] Field of Search ..... 2/94, 108, 126, 250, 2/DIG. 6, 114, DIG. 7

[56] References Cited

UNITED STATES PATENTS

| | | | |
|---|---|---|---|
| 2,073,711 | 3/1937 | Robinsohn | 2/126 |
| 2,465,286 | 3/1949 | Silver | 2/126 X |
| 3,024,466 | 3/1962 | Agostini | 2/126 X |
| 3,380,075 | 4/1968 | Marthinsson | 2/126 |

FOREIGN PATENTS OR APPLICATIONS

| | | | |
|---|---|---|---|
| 1,542 | 1/1910 | United Kingdom | 2/114 |
| 3,452 | 1/1892 | United Kingdom | 2/114 |

OTHER PUBLICATIONS

"Self-Adhering Nylon Tapes," Journal of American Medical Association, Oct. 18, 1958.

*Primary Examiner*—Werner H. Schroeder
*Assistant Examiner*—Moshe I. Cohen

[57] ABSTRACT

A coat garment having semi-detachable sleeves and pocket means for receiving such sleeves in their semi-detached condition; the sleeves having essentially longitudinal, selectively openable seams for accommodating arm removal from such sleeves even while the coat is worn; the sleeves can then be tucked into the pocket means provided, preferably in storage pouch means provided by the back of the coat proximate the sleeve openings, so that these sleeves may be stored, and all of this without necessitating coat removal, whereupon the user enjoys the warmth of the body of the coat without encumbering his arms by sleeves; such sleeves being constructed for easy withdrawal and reinsertion of arms therein prior to reconstitution of the sleeves as respective arm coverings.

3 Claims, 7 Drawing Figures

COAT CONSTRUCTION

The present invention relates to garments such as coats and, more particularly, provides a new and improved coat having storable, semi-detachable sleeves.

In the past, many different types of approaches have been made to provide garments of various types having detachable sleeves. The bare concept of sleeve detachability, standing alone is thus not new, see U.S. Pat. No. 3,380,075, by way of example: convertible blouses and combination vest-and-jacket apparel have likewise been conceived in the ladies-wear industry. See by way of example, U.S. Pat. Nos. 2,690,565 and 2,807,804.

Likewise, other types of garments have been made with various sectors being detachable.

The problem in connection with sleeves is that frequently there is no convenient storage place for the sleeves once they are detached, so that these may be easily retrieved and reinstalled or reconstituted for arm protection and warmth. Additionally, and most importantly, it is frequently desirable to have a garment which, while being worn, can be easily manipulated so that the sleeves can be removed from arm areas and conveniently stored.

Likewise, it is very easy to lose sleeve elements when these are detached from the body of the garment, particularly when there is no convenient place for storage.

In the present invention the coat garment thereof includes sleeves which are semi-detachable from the body of the garment and which include respective longitudinal, selectively openable seams. These releasably closable seams or junctures provide for the convenient withdrawal of the arm from the sleeves of the coat by the user merely protruding his elbow through a respective sleeve seam and then withdrawing his hand from the wrist portion of the garment. This will be performed, of course, at both arm areas so that the user's arms are now free from the sleeves, and this without the necessity of removing the garment from the torso of the wearer. In inclement and cold weather the user may desire greater arm dexterity, but may not wish to expose, even temporarily, the upper part of his body to inclement weather.

Accordingly, in the present invention the coat remains on the body and the arms are simply slipped out of the sleeves in the manner hereinafter fully described. It will be noted that the sleeves, despite arm removal, are still attached at respective restricted areas to the body of the coat. Thereafter, and with the coat body still being worn, the user can conveniently take the sleeves hanging from opposite sides of the coat body and tuck the same into pockets proximate the coat body openings accommodating sleeve placement. The pocket or storage means employed will generally take the form of a front panel which is sewn to the back of the coat and which includes pocket openings proximate the now-exposed sleeve openings of the coat. Accordingly, the wearer will not separate the sleeves from the coat body but rather can immediately store them out of the way at the back of his coat, and this while still wearing the principal portion or body of the coat. At this time, then, the torso is covered and kept warm by the coat body; yet the arms are now free from sleeve covering to improve arm dexterity.

When the sleeves are to be replaced in their original attached condition, the coat can remain on the torso and the sleeves are simply and easily retrieved from their pockets; attachment means such as zippers or fabric fasteners are manipulated at closed and medial points, to preclude separation or inadvertent misalignment and consequent difficulties in reclosure, to reconstitute the sleeves as to themselves and the coat body, once the wearer's arms are slipped therein, and to fasten the remainder of the sleeves securely about each arm opening of the coat body in proper registry as to rotational alignment.

Accordingly, a principal object of the present invention is to provide a new and improved garment such as a coat, having semi-detachable sleeves.

It is a further object of the invention to provide a sleeve-including coat wherein the coat can be worn about the torso while sleeves are being semi-detached from arm areas and, subsequently, replaced.

A further object is to provide a coat having selectively openable and re-attachable seamed sleeves, this whereby the user's arms can be conveniently removed from the sleeves while the coat is being worn, and with the sleeve areas of the coat being conveniently storable in proximate storage areas provided interiorly of the coat.

A further object is to provide a coat having sleeves which can be conveniently removed from the arms and yet which are permanently attached to the coat.

An additional object is to provide a coat having a back provided with sleeve storage means, such coat including semi-detachable sleeves that can be conveniently removed from the arms of the wearer and stored, as desired; yet reconstituted and reapplied over the arms without the wearer at any time needing or employing coat removal, or undue manipulation.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

in FIG. 2 the sleeves are shown semi-detached from the armhole areas of the body of the coat;

Figures 1, 2, 3, 4, 5, 6, 7:
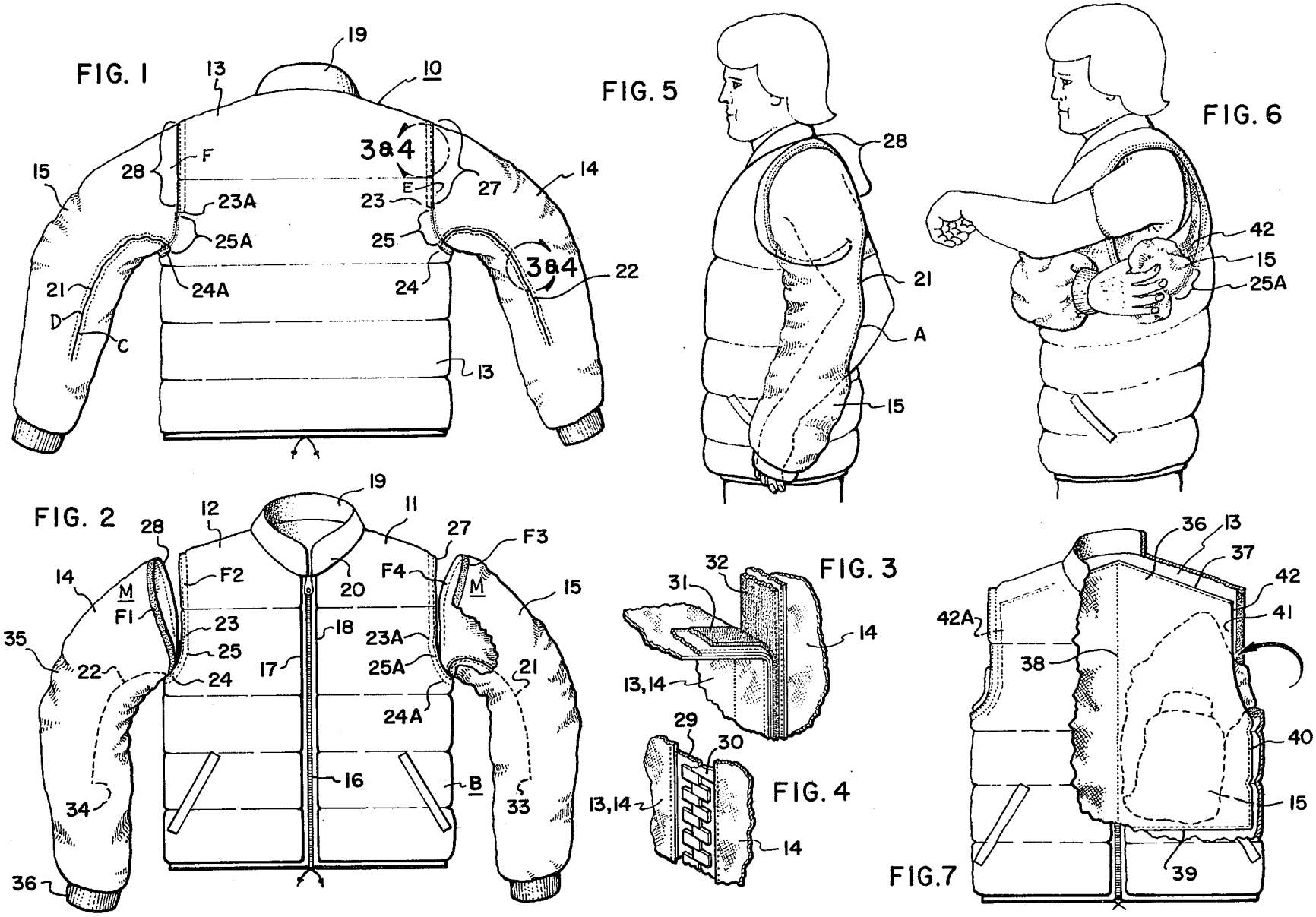
FIG. 1 is a rear elevation of a coat garment designed in accordance with the principles of the present invention and represents a first embodiment thereof.
FIG. 2 is a front view of the coat wherein the front panels are the same and have been closed together as about the torso of the user.
FIG. 3 is an enlarged detail, taken along arcuate lines 3 & 4 in FIG. 1, of representative coat seams at the arm areas, illustrating releasable fabric fasteners such as that going under the tradename VELCRO, for providing releasably closable seams at the arm areas.
FIG. 4 is similar to FIG. 3 but illustrates this time a zipper attachment usable for selectively opening and closing seams at the arm areas, principally at the longitudinal area of the sleeve and also around the shoulder area thereof.
FIG. 5 is a side elevation of the coat worn by the wearer wherein the releasably openable, longitudinal seam of the left arm sleeve is preliminarily opened by the right hand so that the left elbow and arm, wrist and hand areas, can be withdrawn from such sleeve.
FIG. 6 illustrates that once the sleeve of FIG. 5 is essentially removed or semi-detached from the garment, the same can be conveniently folded and stuffed into the pocket area of the back of the coat as hereinafter described.
FIG. 7 is a view of the coat with the sleeves thereof tucked away in garment back storage areas.

In the drawings a coat 10 includes front panels 11 and 12, back 13, and sleeves 14 and 15 having respective upper margins M. Front panels 11 and 12 may be secured together by a zipper 16 or by other means conveniently attached to the adjacent margins 17 and 18 of the front panels of the coat. A neck portion 19 is conveniently sewn at 20 and conjoins the back 13 with front panels 11 and 12.

All of the parts of the cloth portions of the coat can be made of a quilted or other type material, as desired. The sleeves 14 and 15 have an openable, releasably closable, respective joinable seams 21 and 22 leading to points 24 and 24A of the coat. The respective sleeves 14 and 15 are attached at and between 23, 24, and 23A, 24A, to the back 13 such that there is a permanent juncture at lower rear-portions 25, 25A, that can be reinforced by leather, cloth, or other means. Accordingly, the sleeve enjoys a permanent connection to the back at areas 25 and 25A. Otherwise, each sleeve 14 and 15 enjoys a releasable connection by remaining upper margin portion E, F at a releasable seam at 27 and 28. This is to say, the respective arcuate areas of seams 27 and 28, provided with respective zipper halves 29 and 30 or VELCRO mating halves 31 and 32, will traverse approximately 300°–310° about the periphery of the sleeve connection relative to the remainder of the coat. The zipper halves 29 and 30 in FIG. 4 or the VELCRO strips 31 and 32 as shown in FIG. 3 are employed as fastener means at F1 and F2, F3 and F4, for releasably securing the remainder of the sleeve to the coat in the manner shown in FIG. 2.

Openable seams 21 and 22, which form extensions of openable seams 27 and 28, proceed downwardly to points 33 and 34, midway between the sleeve's elbow portion 35 and wrist portion 36.

Most importantly, the back 13 is provided with a front facing panel 36 that is stitched at 37, 38 and 39 as well as at 40, the same configuration being at both sides of the jacket in FIG. 7, and with an openable margin at 41, unstitched to the remainder of the back but which provides a receiving pocket 42, 42A for the respective sleeves, such as sleeve 15 in FIG. 2.

The openable seams 21 and 22, formed of respective longitudinal margins C and D may be conveniently opened by the user operating a VELCRO or zipper means, see FIGS. 3 and 4, typical of both sleeves, so as to open respective slit A of seams 21, 22 as seen in FIG. 5 and also seams 27 and 28. The same applies to the remaining sleeve. Thereafter, and as seen in FIG. 6, by way of example, the user will raise his left arm and use his right to tuck the sleeve, permanently attached at 25A, into the pocket 42 as shown by the dotted line configuration of the sleeve 15 in FIG. 7. This can be conveniently performed by the user simply separating by the fingers of his right hand the seams 27 and 28 and also seams 21 and 22 so that the arm can be removed from the sleeve, the shoulders as well, and the sleeve prepared for insertion in respective pockets 42 and 42A.

Once the operation as shown in FIG. 6 has been completed, then the jacket will assume the configurement as in FIG. 7 wherein the sleeves are effectively tucked in between the back of the jacket and the front panel thereof, which is sewn or otherwise secured to the jacket and which has respective openings or pockets at 42 and 42A.

Accordingly, what is provided is a new and improved jacket having permanently attached sleeves, but also provided with means for receiving the sleeves when the same are partially separated from the body of the jacket so that the sleeves may be tucked into the pockets formed between the back of the jacket and the front panel 29 of such back. Accordingly, a workman, hunter, or other person can effectively "remove" the sleeves so as to leave his arms free without removing the jacket from his body. Also, there is permanent storage for the sleeves in the interior of the jacket, which may be thus stored while the user is still wearing the jacket.

Thus, the jacket is highly versatile, may be worn in the usual way with sleeves where the hunter is out in inclement weather, for example. Yet, the permanently attached sleeves may be partially removed from the body B of the jacket and tucked into "pocket" areas formed by panel 49 even while the coat is being worn, so that the jacket becomes in effect of "sleeveless" design, thereby leaving the sleeve areas free for performing various skills, building trades, and so forth, in fact in any situation where arm dexterity is to be optimized.

While particular embodiments of the invention have been shown and described, it will be obvious to those skilled in the art the various changes and modifications which may be made without departing from the essential features of the present invention and, therefore, the arm in the appended claims is to cover all such changes and modifications as fall within the true spirit and scope of the invention.

I claim:

1. A coat garment including, in combination, a coat body having opposite arm apertures; a pair of semi-detachable sleeves having upper arm-hole margins provided with lower-rear portions solely permanently attached to said coat body proximate said arm apertures, said sleeves also having respective, elongate, arm removal and replacement, mutually and releasably closable longitudinal margins extending longitudinally along said sleeves, said longitudinal margins being so provided with means for so releasably closing said longitudinal margins; and means for releasably securing said sleeves along remaining portions of said upper margins to said coat body, about and over said arm apertures for closed registry therewith, said longitudinal margins respectively extending to said remaining portions to form extensions thereof.

2. A coat garment including, in combination, a coat body having opposite arm apertures; a pair of semi-detachable sleeves having upper arm-hole margins provided with lower-rear portions solely permanently attached to said coat body proximate said arm apertures, said sleeves also having respective, elongate, arm removal and replacement, mutually and releasably closable longitudinal margins extending longitudinally along said sleeves, said longitudinal margins being so provided with means for so releasably closing said longitudinal margins; and means for releasably securing said sleeves along remaining portions of said upper margins to said coat body, about and over said arm apertures for closed registry therewith, said longitudinal margins respectively extending to said remaining portions to form extensions thereof, and wherein said coat body is provided with interior pockets releasably receiving said sleeves, respectively, when in stored condition therein.

3. A coat garment including, in combination, a coat body having opposite arm apertures; a pair of semi-detachable sleeves having upper arm-hole margins provided with lower-rear portions solely permanently attached to said coat body proximate said arm apertures, said sleeves also having respective, elongate, arm removal and replacement, mutually and releasably closable longitudinal margins extending longitudinally along said sleeves, said longitudinal margins being so provided with means for so releasably closing said longitudinal margins; and means for releasably securing said sleeves along remaining portions of said upper margins to said coat body, about and over said arm apertures for closed registry therewith, said longitudinal margins respectively extending to said remaining portions to form extensions thereof, and wherein said coat body is provided with a back, forward panel secured thereto and forming therewith pocket means for receiving said sleeves when in folded condition therein.

* * * * *